United States Patent [19]

Kals

[11] Patent Number: 4,494,599

[45] Date of Patent: Jan. 22, 1985

[54] VACUUM PRODUCING CONDENSER

[75] Inventor: Walter Kals, Hastings-on-Hudson, N.Y.

[73] Assignee: Niagara Blower Company, Buffalo, N.Y.

[21] Appl. No.: 611,613

[22] Filed: May 18, 1984

Related U.S. Application Data

[60] Division of Ser. No. 491,594, May 4, 1983, , which is a continuation-in-part of Ser. No. 324,785, Nov. 25, 1981, abandoned.

[51] Int. Cl.[3] ..... F28F 9/00

[52] U.S. Cl. ..... 165/67; 60/687

[58] Field of Search ..... 60/687; 165/67, 68; 261/153, DIG. 10

[56] References Cited

U.S. PATENT DOCUMENTS

| | | | |
|---|---|---|---|
| 631,363 | 8/1899 | Ferreira | 261/DIG. 10 |
| 1,573,792 | 2/1926 | Allerton | 60/687 |
| 2,265,612 | 12/1941 | Ray | 165/67 X |

FOREIGN PATENT DOCUMENTS

| | | | |
|---|---|---|---|
| 29507 | 3/1977 | Japan | 261/DIG. 10 |

*Primary Examiner*—Stephen F. Husar

*Attorney, Agent, or Firm*—Niro, Jager & Scavone

[57] ABSTRACT

An air cooled vacuum producing condenser is disclosed for condensing vapors containing non-condensible gases, i.e. air. The condenser includes a condenser chamber with a bundle of condenser tubes across the chamber. Inlet and outlet headers are disposed at opposite ends of the chamber. Water is directed downwardly onto the bundle of condenser tubes, and air is discharged from the interior of the chamber to create a downward flow of air through the chamber across the bundle of condenser tubes.

8 Claims, 6 Drawing Figures

FIG. 5
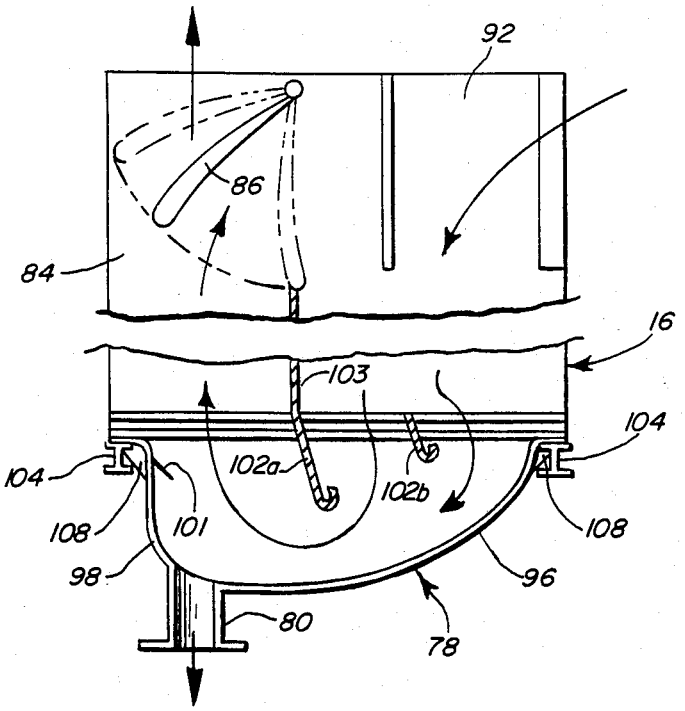
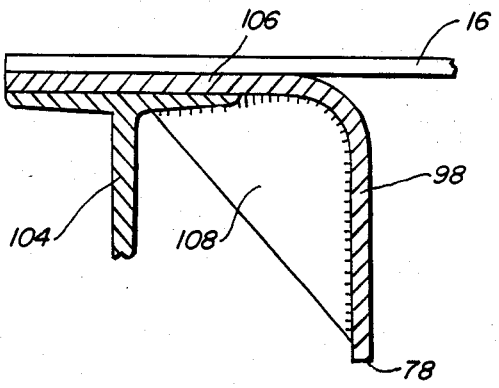
FIG. 6

VACUUM PRODUCING CONDENSER

This application is a division of application Ser. No. 491,594, filed May 4, 1983, which in turn is a continuation-in-part of Ser. No. 324,785 filed on Nov. 25, 1981, now abandoned.

BACKGROUND AND SUMMARY OF THE INVENTION

This invention relates to an air cooled vacuum producing condenser of the evaporative type in which the cooling effect is obtained primarily from the evaporation of water directed onto the exterior of a bundle of condenser tubes arranged in an airstream passing over the tubes.

The invention is an improvement of the condenser shown and described in my U.S. Pat. No. 3,148,516 dated Sept. 15, 1964.

This invention is particularly adapted for relatively large capacities as may be required for condensing the exhaust of steam turbines.

Generally, the present invention eliminates prior sumps as part of the condenser shell and provides a basin which drains as it receives water directed over the bundle of condenser tubes. The basin guides the airstream passing over the tubes smoothly through a 180° turn to exhaust the air out of the condenser chamber while preventing entrainment of water by the exhausted air. Thus, a heavier water cascade over the tube bundle is permitted to maintain the external tube surfaces clean and enhance the transfer of heat.

Other novel features will be apparent from the following detailed description, including a new and improved demister screen and a mechanical vacuum pump utilizing cooling water which also provides a partial replacement of the amount of water evaporating from the water cascade.

An object, therefore, of the present invention is to provide a new and improved air cooled vacuum producing condenser of the character described.

In the exemplary embodiment of the invention, a shell is provided having a generally horizontal condenser chamber. A bundle of condenser tubes is disposed generally horizontally across the condenser chamber. An inlet header is disposed at the inlet end of the bundle of condenser tubes, and a condensate outlet header is disposed at the outlet end of the bundle of condenser tubes. The inlet and outlet headers have portions projecting above the bundle of condenser tubes. A bundle of gas devaporization tubes extend across the condenser chamber and connect the portions of the inlet and outlet headers above the bundle of condenser tubes. Means are provided for directing water downwardly onto the bundle of condenser tubes. Means also are provided for discharging air from the interior of the shell to create a downward flow of air through the condenser chamber across the bundle of condenser tubes.

One feature of the invention includes a demister screen across the interior of the condensate outlet header through which the mixture of vapor and gas is required to pass before entering the bundle of gas devaporization tubes. The screen includes a first portion extending generally horizontally from the condenser chamber at a location between the condenser tubes and the gas devaporization tubes, and a second portion extending diagonally downwardly from a distal end of the first portion across the interior of the condensate outlet header. The portion of the inlet header which is connected by the gas devaporization tubes comprises a separate interior chamber portion of the inlet header, and a drain is provided therefrom to at least one of the condenser tubes for any accumulated condensate from the gas devaporization tubes.

Another feature of the invention is the provision of a basin at the bottom of the condenser chamber for collecting and draining the water directed onto the bundle of condenser tubes. The basin is configured to guide the downward flow of air smoothly through a 180° turn and back upwardly into the condenser chamber for exhaustion therefrom. The basin is contoured to prevent entrainment of water by the exhausted air. More particularly, the basin has a smooth curved wall portion below the bundle of condenser tubes for receiving water directed thereover, and a vertically rising wall portion against which water is directed by the curved wall portion. Baffle means are provided at the top of the basin to direct the air downwardly, so that air will be forced to flow also through the lower portion of the basin. At least one baffle member protrudes inwardly of the vertically rising wall portion to create a stop for any upwardly moving water.

A further feature of the invention includes support means engaging the bottom of the condenser shell for supporting the shell, with the support means being spaced outwardly from the sides of the basin to permit access to the basin sides for servicing purposes. The support means comprises support beams extending along opposite sides of the basin. The basin includes generally horizontal peripheral lip portions sandwiched between the support beams and the bottom of the condenser shell. Vertical supporting gussets are secured integrally between the basin sides, the support beams and the peripheral basin lip portions.

Still another feature of the invention includes a cool water vacuum pump for exhausting non-condensible gases from the condenser, the pump including cooling water intake means. Means is provided for utilizing the cooling water needed for the vacuum pump as a partial replacement of the amount of water evaporating from the water cascade.

Other objects, features and advantages of the invention will be apparent from the following detailed description taken in conjunction with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 5 is a simplified, somewhat schematic view, of a basin and support means of the condenser; and FIG. 6 is an enlarged sectional view of the support means in conjunction with adjacent portions of the basin.

DETAILED DESCRIPTION OF THE INVENTION

Figure 2:
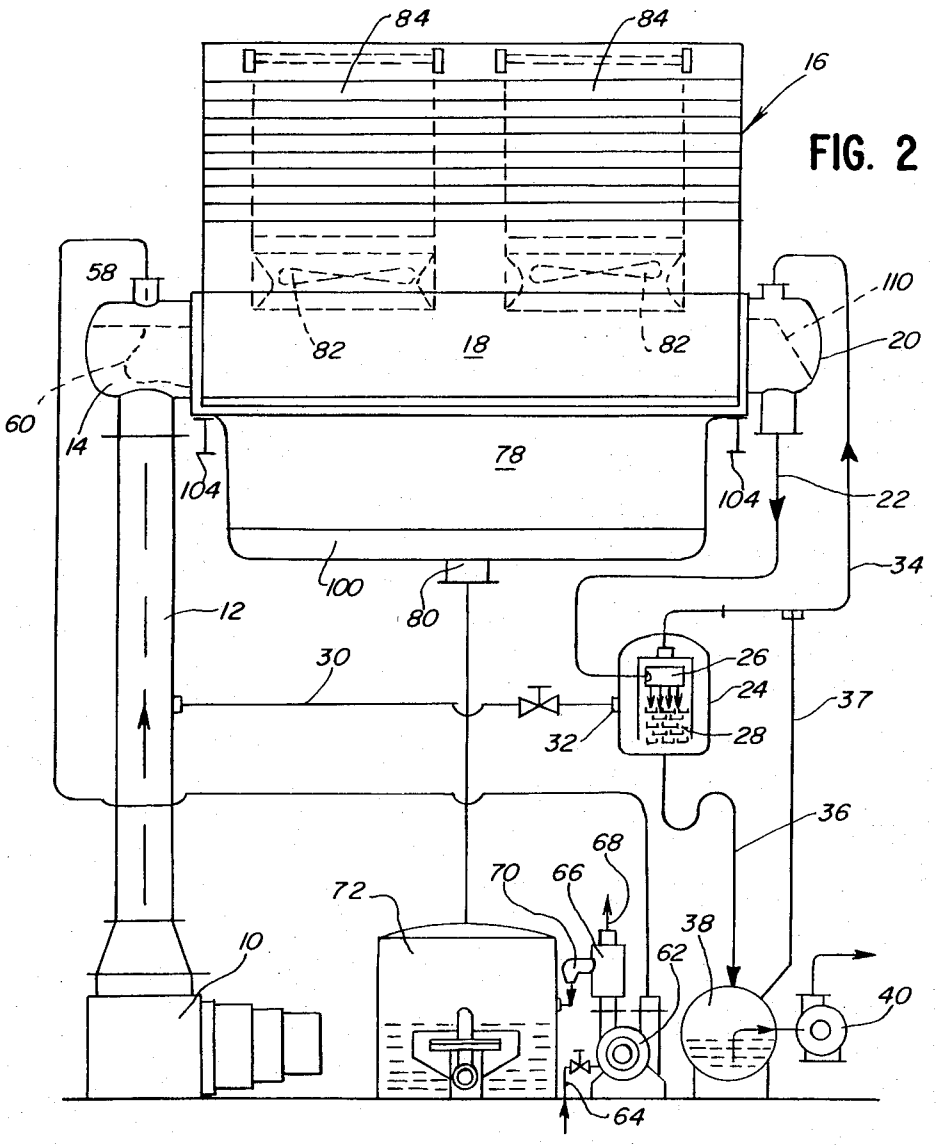
FIG. 2 is a simplified, somewhat schematic front elevational view of the vacuum producing condenser.
Figure 1:
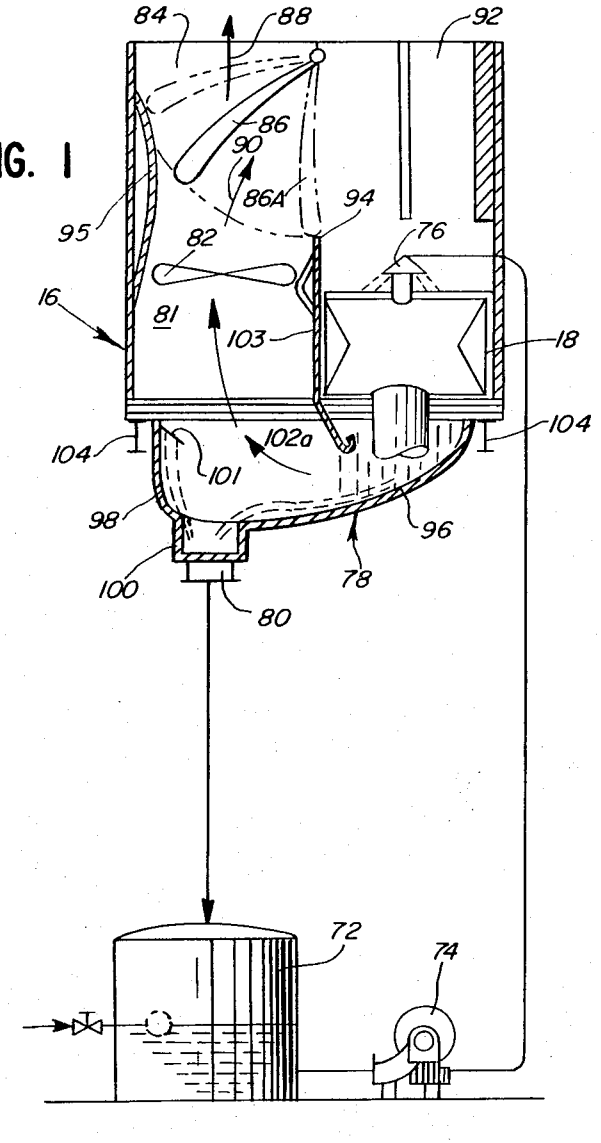
FIG. 1 is a simplified, somewhat schematic end elevational view of a vacuum producing condenser embodying the features of the present invention.

Referring to the drawings in greater detail, and first to FIGS. 1 and 2, the air cooled vacuum producing condenser of the present invention is shown to serve a steam turbine 10 from a boiler (not shown). However, it is to be understood that the features of this invention are not limited to this application. As shown, steam is exhausted upwardly from the turbine, through a conduit 12, to an inlet header 14 of the condenser. The condenser has a shell, generally designated 16, which defines a generally horizontal condenser chamber 18. A condensate outlet header 20 is disposed at the opposite end of the condenser chamber and from which condensate drains from the lower portion of the outlet header, as at 22, into a deaerator 24. The deaerator has a perforated tube 26 which will distribute the condensate over a plurality of trays 28. A portion of steam from conduit 12 of turbine 10, as at 30, enters the deaerator at 32 for movement upwardly through trays 28 to heat and scrub the downward moving condensate. Excess steam is vented from the deaerator, as at 34, into the upper portion of condensate outlet header 20 where this steam will mix with the non-condensible gases as described hereinafter. The deaerated condensate drains through a liquid seal, as at 36, into a receiver 38 from which it is returned to the boiler by a condensate pump 40. Line 37 equalizes the pressure in deaerator 34 and receiver 38 to insure gravity drainage of the condensate.

Deaerators are designed to, by mechanical action, reduce the gaseous content of effluent. Normally the water is heated to and kept at saturation temperature, as the gas solubility is zero at the boiling point of the liquid, and the water is mechanically agitated by spraying or cascading over trays for effective scrubbing, release, and removal of the gases. The gases are swept away by a supply of steam. Heretofore the effluent or condensate to be dearated normally has been supplied at above-atmospheric pressure from an intermediate stage of the condensate pump. Excess steam, together with the release of air, was piped to a watercooled vent condenser.

In contrast, the present invention uses exhaust steam from the turbine 10 to heat and scrub the condensate. The latter is deaerated at a vacuum and the excess steam and released air is piped into the upper portion of condensate header 20 in order to mix with the noncondensible gases disengaging from the condensate. This mixture is then cooled in the devaporizing tubes 54.

Figure 4:
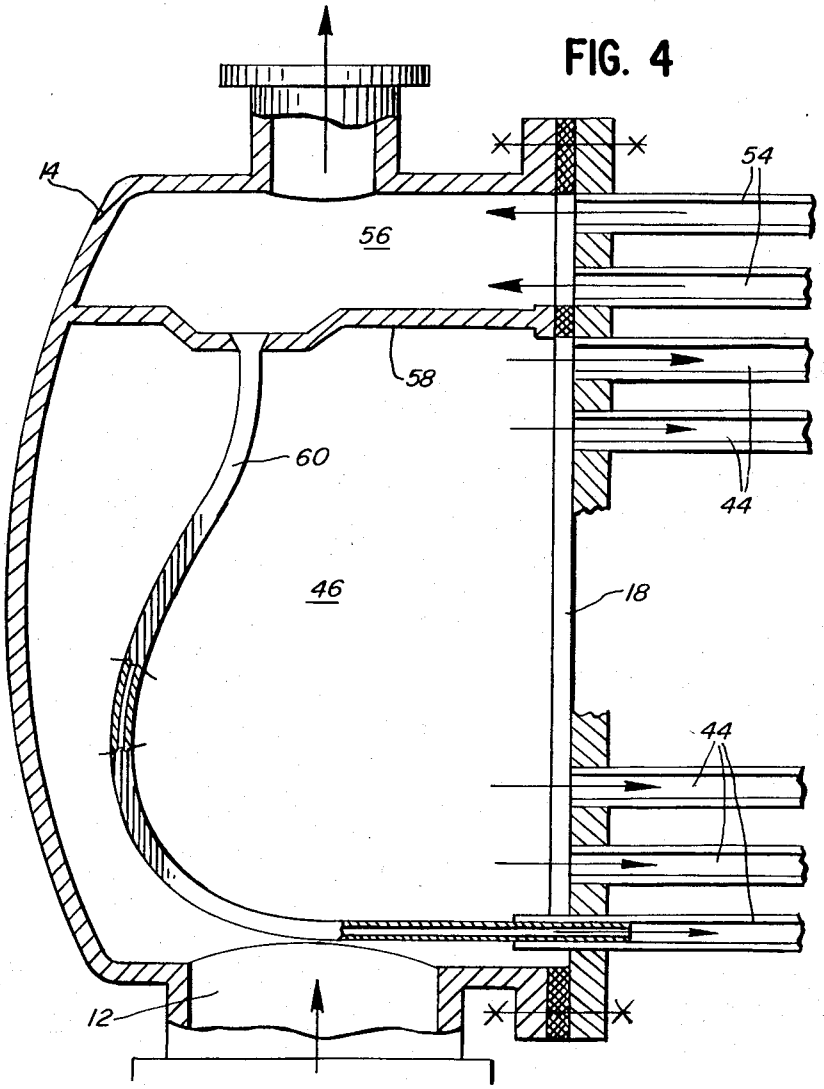
FIG. 4 is a sectional view, on an enlarged scale, of the inlet header of the condenser.
Figure 3:
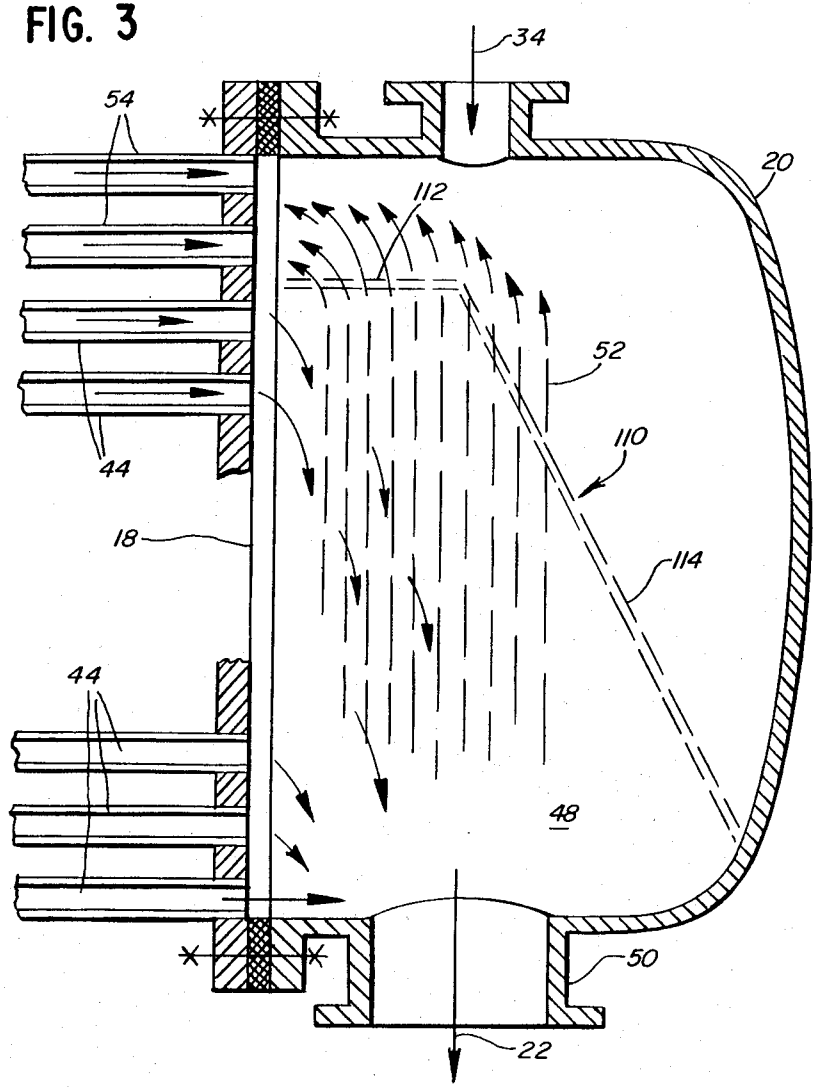
FIG. 3 is a sectional view, on an enlarged scale, of the condensate outlet header of the condenser.

Referring to FIGS. 3 and 4, a bundle of condenser tubes 44 extend generally horizontally across condenser chamber 18. The condenser tubes are slightly inclined downwardly from inlet header 14 to outlet header 20. Steam exhausted through conduit 12 from turbine 10 enters a chamber 46 in inlet header 14 and passes through the condenser tubes to outlet header 20. The steam is condensed as it passes through these tubes, and the condensate drains into a chamber 48 within outlet header 20, downwardly through fitting 50 from the outlet header to deaerator 24. Non-condensible gases, i.e. air, flow upwardly in outlet header 20, as at 52, and are drawn through subcooling or devaporizing tubes 54 which are the upper most tubes of the entire tube bundle including condenser tubes 44. The devaporizing tubes terminate in a separate interior chamber portion 56 (FIG. 4) defined by a partition 58 in the upper portion of inlet header 14. Any condensate accumulating in this upper chamber portion 56 drains through a flexible tube or hose 60 into at least one of the lower condenser tubes 44. The condensate draining therefrom therefore will combine with the condensate leaving outlet header 20 as described above.

The flow of non-condensible gases through devaporizing tubes 54 is induced by a mechanical vacuum pump 62 (FIG. 2). This pump receives cooling water, as at 64, and discharges the cooling water together with air into a separator 66. Air is exhausted to the atmosphere from the separator at 68, and the cooling water overflows at 70 into a collecting tank 72. Thus, the cooling water needed for this mechanical vacuum pump 62 is utilized as a partial replacement of the amount of water evaporating from the water cascade over the devaporizing and condenser tube bundle.

More particularly, referring to FIG. 1, a pump 74 cycles water from collection tank 72 to a spray 76 for cascading water onto the tubes in condenser chamber 28. A basin, generally designated 78, is mounted on the underside of shell 16 for receiving the water cascading over the tube bundle. The basin has a drain 80 for recycling the water back into collection tank 72.

An airstream is discharged from the interior of shell 16 to create a downward flow of air through condenser chamber 18 across the entire tube bundle, followed by an upward flow through an adjacent air plenum 81. More particularly, two propeller fans 82 discharge air into prismatic stacks 84. Each stack has a damper 86 which, at an intermediate position, will divide the air discharge by the propeller 82 into a portion which is exhausted, as at 88, and a portion which is recirculated, as at 90, thereby controlling the capacity of the condenser. Each prismatic stack 84 communicates with an air intake section 92 by a rectangular opening 94 which is fully closed if damper 86 is in a vertical position.

Referring to FIG. 1, each prismatic stack 84 is designed for cooperation with damper 86, in its vertical position, for recovery of the velocity energy which prevails as the air leaves fan 82. More particularly, an interior wall 95 of the stack is formed generally in the shape of a diverging cone. The damper has one side 86A provided with a similar shape, such that the reduced pressure in the fan ring is thereby gradually increased to the atmospheric pressure which prevails at the outlet of the stack. In other words, the velocity recovery stacks recover a portion of the kinetic energy of the air expelled by the fan propeller by converting the velocity head into a pressure head as the walls of the stack gradually diverge.

As seen in FIG. 1, basin 78 is configured to guide the downward flow of air described above smoothly through a 180° turn and back upwardly into shell 16 past propellers 82, while preventing entrainment of water by the exhausted air. More particularly, basin 78 has a smooth curved wall portion 96 below the bundle of devaporizing and condenser tubes in condenser chamber 18, and a vertically rising wall portion 98 against which water is directed by the curved wall portion. Drain 80 at the bottom of basin 78 includes a trough 100 and most of the water which is swept along the bottom of the basin will fall into the trough from which it is drained into collecting tank 72. Any water jumping through 100, or any water entrained by the air, will be swept against vertically rising wall portion 98 and will be stopped by a protruding lip or baffle member 101.

Referring to FIG. 5 in addition to FIG. 1, baffle means is provided in the upper regions of basin 78 to provide a more uniform velocity across the air flow area through the basin as well as to reduce water droplet entrainment in the air. More particularly, a first baffle member 102*a* extends downwardly from a partition 103 which divides shell 16 into condenser chamber 18 and air plenum 81. A second, shorter baffle member 102*b* extends downwardly into the basin at a point generally centrally of the condenser chamber. The baffle members extend longitudinally along the length of the basin.

It can be seen that baffle members 102*a*, 102*b* are angled relative to the vertical against the downward flow of air into the basin from the condenser chamber. The baffle members therefore direct the flow of air and water droplets toward the lower regions of the basin and toward the rising wall portion 98 of the basin. Without this baffle arrangement, the air velocity would be greatest in a flow across the top of the basin, since most of the air would move toward fan 82 over the shortest route. The lowest air velocity then would occur near the bottom of the basin. Since the water droplets agglomerate in their descent, they would be smallest where the air velocity would be greatest and where they would be most readily entrained in the air, causing drift emission of moisture out through the prismatic stacks. Baffle members 102*a*, 102*b* prevent this undesirable condition. It also can be seen that the lower ends of baffle members 102*a*, 102*b* are curved upwardly to form a lip at the bottom of each baffle member. The lips define troughs for any water that might accumulate on the baffle members. The troughs carry the accumulated water to one or both opposite ends of the elongated baffles at the ends of the basin 78 where the water is drained into the basin. To this end the lips or troughs are inclined slightly toward an end of the basin.

Referring to FIGS. 5 and 6, support means in the form of I-beams 104 engage the bottom of condenser shell 16 for supporting the shell. The support beams extend along opposite sides of basin 78 and are spaced outwardly from the sides of the basin a sufficient distance to permit access to the basin sides 96 and 98 and to support beams, described below, for servicing purposes, such as repair, painting, or the like. The basin includes generally horizontal peripheral lip means 106 which are sandwiched between support means in the form of I-beams 104 and the bottom of shell 16. A plurality of vertical supporting gussets 108 are integrally secured, as by welding, between the basin sides, the support beams, and the peripheral lip means of the basin. The gussets are triangularly shaped and provide rigid support of the peripheral lip 106 within the space between the support beams 104 and the basin walls, in order to avoid undue stress at the rounded juncture between the lip and the basin walls. These gussets also provide a rigid support for the sides of the basin and insure that the contour of the basin is maintained.

An important feature of the invention is the provision of a demister screen, generally designated 110 (FIG. 3), which enchances the vertically upward flow of the non-condensible gases past the downward gravity flow of the condensate in outlet header 20. Heretofore, horizontal partitions having "weep holes" were provided in the outlet header for separating the condensate portion of the header and an upper space into which the gases are disengaged. Demister screen 110 extends completely across the header and includes a first portion 112 extending generally horizontally from condenser chamber 18 at a location between condenser tubes 44 and devaporization tubes 54, and a second portion 114 extending diagonally downwardly from the distal end of the first portion across the interior of the condensate outlet header. This configuration of the demister screen promotes counterdirectional flow of the vertically upward drift of the non-condensible gases and the vertically downwardly gravity flow of the condensate for the most effective separation of these two media.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a condenser for vapors containing noncondensible gases, a shell having a generally horizontal condenser chamber with condenser tubes therein, means for directing water downwardly onto the condenser tubes, a basin mounted to the bottom of said shell beneath said condenser chamber for collecting said water directed onto said condenser tubes, and support means engaging the bottom of said shell for supporting the shell, said support means being spaced outwardly from the sides of said basin to permit access to said basin sides for servicing purposes.

2. The combination of claim 1 wherein said support means comprises support beams extending along opposite sides of said basin.

3. The combination of claim 2, further including vertical supporting gussets secured between said basin sides and said support beams.

4. The combination of claim 2 wherein said basin includes generally horizontal peripheral lip means sandwiched between said support beams and the bottom of said shell.

5. The combination of claim 4, further including vertical supporting gussets integrally secured between said basin sides, said support beams and said peripheral lip means.

6. In a condenser for vapors containing noncondensible gases, a shell having a generally horizontal condenser chamber with condenser tubes therein, means for directing water downwardly onto the condenser tubes, a basin mounted to the bottom of said shell beneath said condenser chamber for collecting said water directed onto said condenser tubes, said basin having generally horizontal peripheral lip means projecting outwardly therefrom, and vertical support means integrally secured between said peripheral lip means and the sides of said basin.

7. The combination of claim 6 wherein said vertical support means comprises generally planar supporting gussets.

8. The combination of claim 7 wherein said gussets are generally triangularly shaped.

* * * * *